US006425966B1

(12) United States Patent
Highsmith et al.

(10) Patent No.: US 6,425,966 B1
(45) Date of Patent: Jul. 30, 2002

(54) ENERGETIC PLASTICIZER, AND EXPLOSIVE AND PROPELLANT COMPOSITION CONTAINING SAME

(75) Inventors: Thomas K. Highsmith, North Ogden; Daniel W. Doll, Marriott Slaterville; Louis F. Cannizzo, North Ogden, all of UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/661,557

(22) Filed: Sep. 14, 2000

Related U.S. Application Data

(60) Provisional application No. 60/153,956, filed on Sep. 15, 1999.

(51) Int. Cl.[7] ..... C06B 45/10

(52) U.S. Cl. ..... 149/19.1; 149/19.8; 149/88; 560/264

(58) Field of Search ..... 560/264; 149/88, 149/19.1, 19.8

(56) References Cited

U.S. PATENT DOCUMENTS

| | | | | | |
|---|---|---|---|---|---|
| 2,185,297 | A | | 1/1940 | Gloor | 260/488 |
| 2,340,268 | A | | 1/1944 | Hass et al. | 260/488 |
| 2,374,484 | A | | 4/1945 | Haas et al. | 260/488 |
| 2,522,959 | A | | 9/1950 | Plaut | 260/635 |
| 3,000,933 | A | | 9/1961 | Herzog | 260/488 |
| 3,223,725 | A | | 12/1965 | Hill | 260/471 |
| 3,396,187 | A | | 8/1968 | Benziger et al. | 260/263 |
| 3,865,658 | A | * | 2/1975 | Flynn | 149/19.3 |
| 3,901,974 | A | * | 8/1975 | Gold et al. | 424/301 |
| 4,258,208 | A | * | 3/1981 | Kao et al. | 560/263 |
| 4,332,744 | A | | 6/1982 | Gilligan et al. | 260/463 |
| 4,476,332 | A | * | 10/1984 | Nalepa | 560/263 |
| 4,546,200 | A | | 10/1985 | Sitzmann et al. | 560/222 |
| 4,910,322 | A | * | 3/1990 | Grakauskas et al. | 549/321 |
| 5,205,983 | A | | 4/1993 | Camp et al. | 149/97 |
| 5,449,835 | A | | 9/1995 | Hamilton et al. | |
| 5,529,649 | A | | 6/1996 | Lund et al. | 149/19.3 |
| 5,648,556 | A | | 7/1997 | Hamilton et al. | |
| 5,690,868 | A | | 11/1997 | Strauss et al. | 264/3.1 |
| 5,798,481 | A | | 8/1998 | Manning et al. | 148/19.8 |
| 5,844,165 | A | | 12/1998 | Canterberry et al. | 148/19.5 |
| H78 | H | | 7/1986 | Adolph et al. | 560/110 |

OTHER PUBLICATIONS

Leach et al., Plasticisers in Energetic Materials Formulations—A UK Overview, p. 2–2 to 2–14 (1988).

Kissinger et al., 28 Journal of Organic Chemistry, "gem–Dinitro Esters. IV. Pyridine–Catalyzed . . . Alcohols", p.2491–2494 (1963).

Ungnade et al., 31 Journal of Organic Chemistry, "Esters and Ethers . . . 1–alkanols", Feb. 1966, p. 369–371 (1966).

Garver, et al. "Catalyzed . . . Salts", J. Org. Chem. 1985, vol. 50, p. 16–99–1702 (1985).

Krimen, "Acetic Formic Anhydride", Organic Synthesis, Collective vol. 4 (1988).

* cited by examiner

*Primary Examiner*—Edward A. Miller
(74) *Attorney, Agent, or Firm*—Sullivan Law Group

(57) ABSTRACT

2,2-dinitro-1,3-propanediol-diformate is a novel low sensitivity, energetic plasticizer that is useful in explosive and propellant compositions. 2,2-dinitro-1,3-propanediol-diformate can be made by reacting 2,2-dinitro-1,3-propane diol with acetic formic anhydride in the presence of pyridine and at least one solvent.

16 Claims, 1 Drawing Sheet

ENERGETIC PLASTICIZER, AND EXPLOSIVE AND PROPELLANT COMPOSITION CONTAINING SAME

RELATED APPLICATIONS

Priority is claimed from provisional application 60/153,956 filed in the U.S. Patent & Trademark Office on Sep. 15, 1999, the complete disclosure of which is incorporated herein by reference.

BACKGROUND OF THE INVENTION

1. Field of the Invention

This invention is directed to a low sensitivity, energetic plasticizer that is especially useful for explosive and propellant compositions.

2. Description of the Related Art

Energetic materials have found widespread use, perhaps no more extensively than in composite propellants and explosive compositions.

Both solid propellants and explosives are commonly made by preparing a mixture of a finely divided organic or inorganic oxidizing agent, a liquid polymeric binder, a plasticizer as a processing aid, and optionally one or more of the following ingredients: a metallic fuel; an energetic solid fuel or explosive fill; a curative and curing agent; and various modifying agents and other additives. In the case of a solid propellant, ballistic modifiers may also be added. Once prepared, the mixture is cast into a suitable structure, such as a rocket motor case for propellants, then subject to curing, if appropriate, i.e., if a curative and cure catalyst have been included. The polymeric binder acts both as a fuel for reaction with the oxidizing agent and as a binder to provide the cast composition with desired physical properties.

The development of a functionally satisfactory energetic composition useful for explosives and propellant systems requires consideration of an extraordinarily complex combination of characteristics. On the one hand, the compositions usually are expected to pass relatively high performance criteria, even under extreme environments to which such compositions are exposed in normal operations. On the other hand, factors such as processability, safety, environmental impact, and costs must also be considered, often to the detriment of energetic performance. Among the most critical safety issues are thermal stability and detonation insensitivity. Explosive and propellant compositions advantageously should have sufficiently low sensitivities to impact so that accidental detonation or ignition do not occur during handling, storage, and transport of the compositions.

As mentioned above, plasticizers are usually incorporated into energetic compositions as processing aids to improve the workability, flexibility, and/or distensibility of the binder of the composition. These improvements are accomplished by, for example, altering mechanical properties such as glass transition temperature or formulation viscosity. One of the better known and more frequently used plasticizers, BDNPA/F (more formally known as bis(2,2-dinitropropyl) acetal/bis(2,2-dinitropropyl)formal), has found acceptance in the art due to its ability to lower viscosity and improve workability of polymeric compositions. BDNPA/F is also attractive because its synthesis can be conducted in an environmentally friendly manner, as disclosed in U.S. Pat. Nos. 5,648,556 and 5,449,835. However, as in the case of many other plasticizers, BDNPA/F is oxygen deficient, making BDNPA/F relatively low in energy capacity. Also, BDNPA/F has shown good chemical compatibility with only selected binders.

It has long been thought that compromise among these divergent concerns of energetic performance, processability enhancement, and safety could be found by the use of an energetic plasticizer in place of BDNPA/F. One of the best known energetic plasticizers is nitroglycerine, which is well known for its use with nitrocellulose in double-base and triple-base propellants and explosive powders. A significant drawback shared by nitroglycerine and other nitrate ester-containing molecules, and polyolpolynitrates, such as diethyleneglycol-dinitrate (DEGDN) and triethyleneglycol-dinitrate (TEGDN), is their poor thermal stability and high shock sensitivity, which make compositions containing such plasticizers dangerous to handle and extremely prone to accidental detonation. Additionally, preparatory processes are complicated by the need to use $NO_x$ scavengers.

Thus, although it has been long recognized that energetic nitrate-containing compounds, such as nitrate esters, exhibit excellent plasticizing properties with a variety of polymeric binders and sufficiently high energetic performances for many propulsive and explosive applications, conventional plasticizers disadvantageously exhibit shock sensitivities and thermal stabilities that are inadequate for many of the environments and the handling which such plasticizers encounter.

SUMMARY OF THE INVENTION

It is, therefore, an object of this invention to fulfill the long-felt need in the art outlined above by providing a plasticizer that is at least as energetic as nitrate ester-containing plasticizers, but exhibits far superior shock sensitivity and thermal stability than nitrate ester-containing plasticizers, and in particular nitroglycerine.

In accordance with the principles of this invention, the above and other objects are attained with the use of a novel plasticizer, 2,2-dintrio-1,3-propanediol diformate (also referred to herein as A-diol-diformate or ADDF) having the molecular formula $C_5H_6N_2O_8$ as a chemical structure as follows:

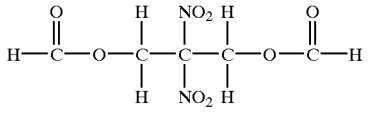

The present inventors discovered that because the ADDF structure is at least essentially free, if not completely free of nitrate esters, yet contains ester groups, the poor thermal stability and shock sensitivity characteristics associated with conventional nitrate ester plasticizers such as nitroglycerin, DEGDN, and TEGDN, can be overcome without sacrificing energetic properties.

This invention is also directed to explosive and propellant compositions having, as an ingredient, ADDF as a plasticizer.

This invention is further directed to ordnances (or munitions) and rocket motors comprising said explosive and propellant compositions.

This invention is still further directed to a method of making ADDF.

These and other objects, features, and advantages of this invention will be apparent to those skilled in the art upon reading the specification, when taken in conjunction with the accompanying Figure, which explain the principles of this invention.

Figure 1B:
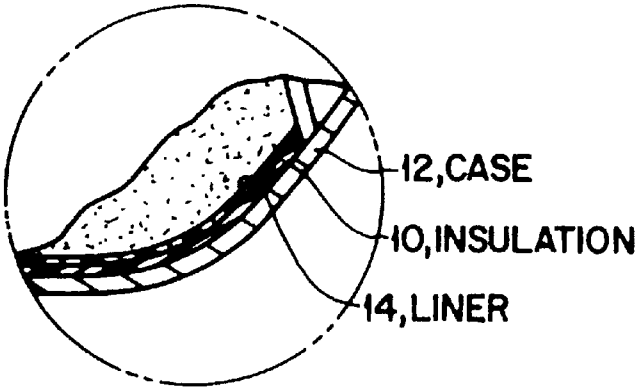
FIGS. 1A and 1B depict an embodiment of a rocket motor assembly in which a propellant composition comprising the novel plasticizer of this invention may be used.

DETAILED DESCRIPTION OF THE INVENTION 2,2-dintrio-1,3-propanediol diformate [$HOCOCH_2C(NO_2)_2CH_2OCOH$] (that is ADDF) is synthesized by the esterification of 2,2-dinitro-1,3-propane diol.

Several techniques are known in the art for preparing 2,2-dinitro-1,3-propane diol. One technique for making the 2,2-dinitro-1,3-propane diol is an oxidative nitration technique, such as is disclosed in U.S. Pat. No. 2,555,959 to Plaut and L. Garvey, Journal of Organic Chemistry, *Catalyst Oxidative Nitration of Nitronate Salts,* 1985, 50, 1699–1702, the complete disclosures of which are incorporated herein by reference. According to this oxidative nitration technique, a nitroalkyl or nitroalkyl derivative, such as nitromethane or tris-hydroxymethylnitromethane, is mixed with formaldehyde in a hydroxide (e.g., sodium hydroxide) solution. The solution is then reacted with a nitrite salt and a persulfate salt in the presence of a suitable catalyst, such as a ferricyanide salt. The temperature of the reaction solution during this stage of the reaction is preferably maintained within a range of from about 0° C. to about 60° C., more preferably from about 10° C. to about 40° C.

The Ter-Mer reaction technique can also be used to form 2,2-dinitro-1,3-propane diol. According to this technique, chloronitromethane is treated with formaldehyde. This technique is reported by H. Feuer et al. in Journal of Organic Chemistry (1950), page 1500, the complete disclosure of which is incorporated herein by reference.

Next, 2,2-dinitro-1,3-propane diol is subject to esterification with acetic formic anhydride. This reaction is conducted in the presence of pyridine and a solvent, such as methylene chloride, THF, or other known or novel compatible organic solvents. The temperature of the reaction medium during this stage of the reaction should be maintained within a range of from about −10° C. to about 30° C., more preferably from about 0° C. to about 10° C. Esterification techniques are generally discussed in Olah et al., Chemical Reviews, Vol. 87, Number 4, pp. 672–86 (1987).

ADDF has been found to exhibit the following properties:

TABLE

| PROPERTY | VALUE |
|---|---|
| ΔHf (heat of formation) | −145.5 kcal/mole (measured) |
| Density | 1.474 |
| Boiling Point | about 90° C. 0.05 mmHg |
| VTS (100° C./48 hours) (vacuum thermal stability) | 1.602 |
| Freezing Point | Below −60° C. |
| ABL Impact | 11 cm |
| ABL Friction | 800 lb @ 8 ft/sec |
| ESD Unconfined | More than 8J |
| ESD Confined | 8J |
| SBAT onset | 122° C. (252° F.) |
| TC Impact | 117 cm (46 inches) |
| TC Friction | More than 64 lb |
| IHE (mini) NO GO | NO GO @ 0 cards |
| DSC onset | @ 289° C. |

ADDF may be used in combination with conventional or novel propellant and solid explosive ingredients as the basis for formulating very high performance insensitive propellant and explosive compositions. Propellant and explosive compositions suitable for use with ADDF are taught in U.S. Pat. Nos. 5,587,553 and 5,690,868, the complete disclosures of which are incorporated herein by reference.

Representative explosive materials that can be made with ADDF, as the sole plasticizer or one of a plurality of plasticizers, include melt cast explosives, cast cure explosives, and extruable explosives.

Melt cast explosives containing the ADDF plasticizer can be prepared with an energetic or inert material having a relatively low melt temperature (<120° C.), and generally comprise a melt cast phase and a solid fill phase. The melt cast phase includes one or more meltable energetic materials, such as TNT (2,4,6-trinitrotoluene) and/or TNAZ (1,3,3-trinitroazetidine), together with the ADDF plasticizer. Other meltable energetic materials which may be used include AN/NQ (ammonium nitrate/nitroguanidine) eutectic or alkylammonium nitrate salts. Inert meltable materials such as polyethylene and hydrocarbon wax may also be used. The solid fill phase is generally made of a nitramine explosive such as HMX or RDX, one or more oxidizers, and one or more metals. Overall, the meltable energetic materials constitute 40–60 wt % of the compositions, while the ADDF may constitute from 0.5–10 wt % of the composition. Of the remaining solid fill phase, from 0–20 wt % may be metals, 0–40 wt % oxidizer, and 40–100 wt % of the nitramine.

Cast cure explosives in which the ADDF plasticizer may be used generally comprise as ingredients 5–20 wt % of one or more binders, 0.5–3 wt % of one or more curatives, 0.25–2 wt % of one or more cure catalysts, and 20–80 wt % of one or more oxidizers, which may include ammonium perchlorate, ammonium nitrate, and nitramines such as HDX or RDX. The ADDF plasticizer (and other plasticizers, if applicable) is/are present in a weight ratio of 0.5:1 to 3:1 plasticizer relative to the binder.

Typical formulations for extudable explosives include 5–35 wt % of one or more thermoplastic elastomers, 0–65 wt % of one or more oxidizers, 0–90 wt % of one or more explosive fillers such as nitramines, 0–40 wt % of metals, and 0–25 wt % of one or more plasticizers, including ADDF.

ADDF may also be used in conjunction with the preparation of composite propellant formulations, including minimum smoke, reduced smoke, and smokey propellants.

Minimum smoke propellants generally include as ingredients the following: 4–30 wt % of binder, 0.5–3 wt % of one or more curatives, 0.25–2 wt % of one or more cure catalysts, 40–80 wt % oxidizers, 0–50 wt % of energetic solid fuels such as nitramines, and 0–30 wt % of ADDF and, optionally, one or more other plasticizers. Other additives, such as 0–5 wt % ballistic modifiers, may also be added.

Typical formulations for the reduced smoke propellants generally are similar to minimum smoke propellants. However, if ammonium perchlorate is selected as a component of the oxidizer and/or aluminum or aluminum oxide is selected as a component of the fuel, the ammonium perchlorate and aluminum are used in sufficiently low amounts to retain the desired reduced smoke properties. Generally, ammonium perchlorate is present in an amount of not more than 90 wt % and aluminum is present in an amount of not more than 3 wt % for reduced smoke propellants.

Typical formulations for the smokey propellants generally are similar to those of reduced smoke propellants, but do not contain undue restrictions on the smoke generating components, such that aluminum can be used in concentrations as high as about 22 wt % (as limited by combustion efficiency) and the ammonium perchlorate can be used in concentrations as high as about 80 wt % (as limited by theoretical performance).

The ADDF can also be used in nitrocellulose-base propellants, including double-base and triple-base propellants. A typical formulation for a double-base propellant includes, as its main ingredients, 10–90 wt % nitrocellulose and 10–90 wt % plasticizer. ADDF can be 1–100 wt % of the plasticizer. When used in combination with other plasticizers, ADDF has a synergistic relationship with commonly used nitrate esters, for example nitroglycerin. A typical formulation for a triple-base propellant includes, as main ingredients, 10–90 wt % nitrocellulose and 10–90 wt % plasticizer, and nitroguanidine. More complex double-base and triple-base propellant formulations, such as extrudable or castable formulations, may include other components, such as curatives, oxidizers, and fuels. Preparation of such formulations, including determinations of suitable constituent concentrations, is within the purview of a person of ordinary skill in the art having reference to this disclosure.

The binders can be energetic, inert, or a combination (e.g., mixture, copolymer or terpolymer) thereof. Representative inert polymeric binders that may be used with ADDF include HTPB (hydroxy-terminated polybutadiene), PBAN (butadiene-acrylonitrile-acrylic acid terpolymer), PPG (polypropylene glycol), PEG (polyethylene glycol), polyesters, polyacrylates, polymethacrylates, CAB (cellulose acetate butyrate), or mixtures and copolymers thereof. Representative energetic polymeric binders that may be used with ADDF include PGN (poly(glycidyl nitrate)), poly-NMMO (poly(nitratomethyl-methyloxetane)), GAP (polyglycidyl azide), 9DT-NIDA (diethyleneglycol-triethyleneglycol-nitraminodiacetic acid terpolymer), poly-BAMO (poly(bisazidomethyloxetane)), poly-AMMO (poly(azidomethyl-methyloxetane)), poly-NAMMO (poly(nitraminomethyl-methyloxetane)), copoly-BAMO/NMMO, BAMO/AMMO, or mixtures and copolymers thereof, with PGN and GAP being preferred. The binder can optionally be halogenated, such as fluorinated ethylene propylene copolymer, chlorotrifluoroethylene and vinylidene fluoride copolymer, polyvinylidene fluoride, polydifluorochloroethylene, fluorinated polyethers, PVC, polytetrafluoroethylene, or mixtures thereof. ADDF can also be used with a double-base or multi-base propellant containing nitrocellulose as the binder.

Representative oxidizers include AP (ammonium perchlorate), AN (ammonium nitrate), HAN (hydroxylammonium nitrate), ADN (ammonium dinitramide), HNF (hydrazinium nitroformate) or mixtures thereof.

Representative reactive metals include aluminum, magnesium, boron, titanium, zirconium, silicon, or mixtures thereof. The metals may be present as a powder, particles, and/or in other forms.

Energetic solid fuels (for propellants) or explosive fill (for explosives) that can be used in combination with ADDF include TEX (4,10-dinitro-2,6,8,12-tetraoxa-4,10-diazatetracyclo-[$5.5.0.0^{5,9}0^{3,11}$]-dodecane), RDX (1,3,5-trinitro-1,3,5-triaza-cyclohexane), HMX (1,3,5,7-tetranitro-1,3,5,7-tetraaza-cycloocatane), NTO (3-nitro-1,2,4-triazol-5-one), NQ (nitroguanidine), HNIW (2,4,6,8,10,12-hexanitro-2,4,6,8,10,12-hexaazatetracyclo[$5.5.0.0^{5,9}0^{3,11}$] dodecane), TATB (1,3,5-triamino-2,4,6-trinitrobenzene), and DADNE (1,1-diamino-2,2-dinitro ethylene).

ADDF may also be used to prepare high solids (>90% explosive content) pressable or extrudable explosives. The pressable or extrudable explosives can also contain inert and/or other energetic plasticizers. Representative inert plasticizers include DOA (dioctyladipate), IDP (isodecylperlargonate), DOP (dioctylphthalate), DOM (dioctylmaleate), DBP (dibutylphthalate), oleyl nitrile, or mixtures thereof. Representative energetic plasticizers include BDNPA/BDNPF (bis(2,2-dinitropropyl)acetal/bis(2,2-dinitropropyl)formal), TMETN (trimethylolethanetrinitrate), TEGDN (triethyleneglycoldinitrate), DEGDN (diethyleneglycol-dinitrate), NG (nitroglycerine), BTTN (butanetrioltrinitrate), alkyl NENA's (nitratoethylnitramine), or mixtures thereof.

Exemplary curatives include isocyanates. Exemplary cure catalysts include Lewis acids, triphenylbismuth, alkyltin compounds, such as dibutyltindiluarate.

A list of representative ballistic modifiers include, for example, Lewis acids, iron oxide, lead and its salts, and organometallic compounds of iron or lead, such as catocene.

Figure 1A:
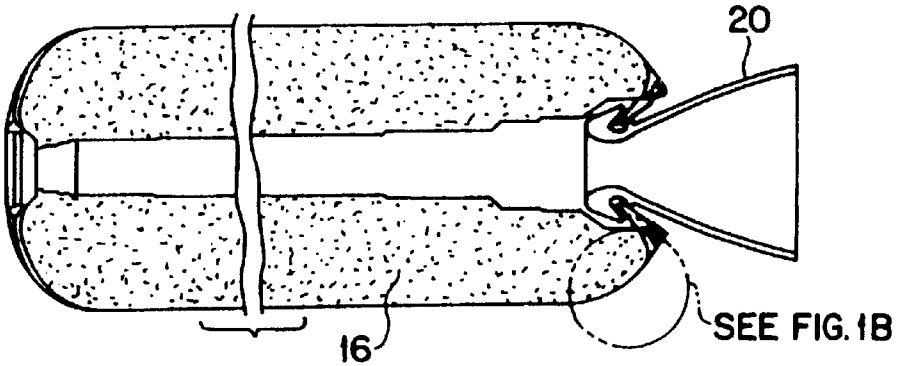

An example of a rocket motor assembly suitable for use with the present invention is shown in FIGS. 1A and 1B. The assembly includes a case 12 coupled to a nozzle 20. A cured propellant 16 is loaded within the interior surface of the rocket motor case 12. Typically, insulation 10 and a liner 14 are interposed between the case 12 and the propellant 16. The insulation 10 and liner 14 serve to protect the case from the extreme conditions produced by the burning propellant 16. The liner 14 also functions to bond the propellant 16 to the insulation 10 or uninsulated portions of the case 12. Methods for loading a rocket motor case 12 with an insulation 10, a liner 14, and propellant 16 are known to those skilled in the art, and can be readily adapted within the skill of the art without undue experimentation to incorporate the insulation of this invention. Liner compositions and methods for applying liners into a rocket motor case are also well known in the art, as exemplified by U.S. Pat. No. 5,767,221, the complete disclosure of which is incorporated herein by reference.

Various forms of munitions, ordnances, and other explosive devices may be used in connection with this invention. A representative, but non-exclusive, example of an ordnance is disclosed in U.S. Pat. No. 3,661,086, the complete disclosure of which is incorporated herein by reference. Generally, munitions and ordnances comprise an explosive fill, an outer case (optionally capable of fragmentation into shrapnel), optionally a liner (typically metal), a fuse system, and a detonator.

The following examples are offered to further illustrate the synthesis methods of the present invention. These examples are intended to be exemplary and should not be viewed as exhaustive of the scope of the invention.

EXAMPLES

Example 1

Synthesis of 2,2-dinitro-1,3-propanediol from Trishydroxymethylnitromethane In a 5-liter jacketed, three-neck, round bottom flask equipped with a mechanical stirrer, thermometer, nitrogen purge, and condenser were placed 151 g (1 mole) of trishydroxymethylnitromethane (Aldrich Chemical Co.) in 750 ml of distilled water. To this solution, 80 g (2 moles) of sodium hydroxide pellets were then added in one portion. The reaction temperature was moderated by maintaining a flow of chilled water through the jacket. The temperature quickly climbed to 35° C. and then gradually fell to 13° C. within a few minutes. After 0.5 hr at this temperature a suspension of 32 g (0.10 mole) potassium ferricyanide and 276 g (4 moles) sodium nitrite in 1 liter of distilled water was added. Immediately afterwards, 240 g (1 mole) solid sodium persulfate was added in two portions at such a rate that the temperature did not exceed 32° C. The cooling was discontinued after the last portion of persulfate was added and the reaction allowed to proceed for one hour. The pH of the reaction at this time was 8. Five hundred ml of diethyl ether were then added and agitated into the aqueous phase for five minutes. The phases were allowed to separate and the organic solution collected. Three more extractions with 500 ml of ether were performed (as above) and then combined, dried with magnesium sulfate, filtered, and evaporated providing 66 g of a pale yellow oil. The product was crystallized by stirring with 100 ml of methylene chloride for a few minutes.

Example 2

Synthesis of 2,2-dinitro-1,3-propanediol from nitromethane and formaldehyde

In a 5-liter jacketed, three-neck, round bottom flask equipped with a mechanical stirrer, thermometer, nitrogen purge, and condenser were placed 61 g (1 mole) of nitromethane (Mallinkrodt Chemical Co.) and 480 g (6 moles) of 37% aqueous formaldehyde solution in 150 ml of distilled water. To this solution, 0.25 ml of a 25% aqueous solution of sodium hydroxide was then added. The reaction temperature was moderated by maintaining a flow of chilled water through the reactor jacket. The temperature quickly climbed to 50° C. and then gradually fell to 15° C. To this solution, 80 g (2 moles) of sodium hydroxide pellets were then added in one portion. The temperature again climbed to 30° C. and the reaction was allowed to come to 13° C. After 0.5 hr at this temperature, a suspension of 32 g (0.10 mole) potassium ferricyanide and 276 g (4 moles) sodium nitrite in 800 ml of distilled water was added. Immediately afterwards 240 g (1 mole) of solid sodium persulfate were added portion-wise at such a rate that the temperature did not exceed 40° C. with the chiller disconnected from the reactor jacket. The reaction was stirred without further treatment for one hour at which time the pH of the now distinctly cloudy solution was between 7–8 and the temperature had dropped to 34° C. Five hundred ml of diethyl ether were then added and agitated into the aqueous phase for five minutes. The phases were allowed to separate and the organic solution collected. Two more extractions with 500 ml of ether were performed (as above) then combined, dried with magnesium sulfate, filtered, and evaporated under vacuum in a rotary evaporator, providing 94.2 g of a pale yellow oil. Crystallization was induced by trituration with methylene chloride.

Example 3

ADDF Synthesis from formic acetic anhydride and 2,2-dinitro-1,3-propanediol

In a 5-liter jacketed, three-neck, round bottom flask equipped with a chiller, a mechanical stirrer, thermometer, nitrogen purge, (through a Claisen adapter) pressure equalized dropping funnel, and condenser were dissolved 107 g (0.64 mole) of thrice recrystallized 2,2-dinitro-1,3-propanediol in 1 liter of anhydrous methylene chloride (Aldrich Chemical Co.). The temperature of the reactor contents was adjusted to 8° C. and dry pyridine (142 g, 1.82 moles, Aldrich Chemical Co), distilled from calcium hydride) was added. To this mixture was added freshly prepared formic acetic anhydride (150 g, 1.70 moles) dropwise at such a rate that the temperature remained at or below 8° C. Following the addition the reaction was allowed to stir under these conditions for 1 hour. At this time thin layer chromatographic analysis (ethyl acetate: hexane, 1:1) indicated that all the starting diol had been consumed. The contents of the reactor were then transferred to a separatory funnel, washed three times with 500 ml of a 10% HCl solution, three times with 500 ml of a saturated sodium bicarbonate solution and once with 500 ml of water. The organic phase was then dried over magnesium sulfate, filtered through a plug of silica gel, and evaporated under reduced pressure, providing 117 grams of a clear oil. $^{1}$HNMR (Bruker 200 MHz): δ8.04, s, 2H; δ5.09, s, 4H; acetylation impurity δ2.11, s, CH3., $^{13}$C: δ158.6, 87.2, 63.5. DSC onset (20 C./min; 282.1° C. IR (cm$^{-1}$): 3025.6 weak, 2963.9 weak, 2890.9 weak, 1723.7 strong, 1566.6 strong, 1448.8 moderate, 1342.2 moderate, 1123.3 very strong, 954.9 moderate, 764.2 moderate, 736.1 moderate. The product may be distilled at approximately 90° C. @ 0.05 mm Hg.

Example 4

A propellant formulation was prepared by mixing the following ingredients in accordance with techniques known in the art:

32.45 wt % of 12.6% nitrogen nitrocellulose 61.85 wt % BTTN 2.7 wt % ADDF 1.20 wt % methyl nitroanaline MNA (stabilizer)

0.75 wt % ballistic modifier 0.25 wt % carbon black 0.3 wt % Desmodur N-100 isocyanate curative (from 3M)

Examples 5 and 6

Energetic formulations were prepared by hand mixing plastisol nitrocellulose (PNC) with ADDF in PNC:ADDF ratios of 1:1 and 1:2. The formulations had the following properties:

TABLE 2

| PROPERTY | 1:1 | 1:2 |
|---|---|---|
| ABL Impact | 11 cm | 33 cm |
| ABL Friction | 800 Lb @ 8 ft/sec | 660 @ 8 ft/sec |
| ESD Unconfined | more than 8J | more than 8J |
| ESD Confined | 8J | 8J |
| SBAT onset | 122° C. (252° F.) | 114° C. (237° F.) |
| TC Impact | more than 117 cm (46 inches) | more than 117 cm (46 inches) |
| TC Friction | more than 64 lbs | more than 64 lbs |

The foregoing detailed description of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

We claim:

1. 2,2-dinitro-1,3-propanediol-diformate.

2. A composition comprising as ingredients 2,2-dinitro-1,3-propanediol-diformate, and one or more additional ingredients effective to form a low sensitivity, high performance explosive or propellant.

3. The composition of claim 2, wherein said composition is a melt cast explosive composition and said additional ingredients comprise at least one energetic material selected from the group consisting of 2,4,6-trinitrotouene (TNT) and 1,3,3-trinitroazetidine (TNAZ).

4. The composition of claim 3, wherein said energetic material is present in an amount of from 40 wt % to 60 wt % based on the total weight of the composition.

5. The composition of claim 4, wherein the 2,2-dinitro-1,3-propanediol-diformate is present in an amount of from 0.5 wt % to 10 wt % based on the total weight of the composition.

6. The composition of claim 2, wherein said composition is a cast cure explosive composition and said additional ingredients comprise 5 wt % to 20 wt % of one or more binders, 0.5 wt % to 3 wt % of one or more curatives, 0.25 wt % to 2 wt % of one or more cure catalysts, and 20 wt % to 80 wt % of one or more oxidizers.

7. The composition of claim 6, wherein a weight ratio of binders to the 2,2-dinitro-1,3-propanediol-diformate and other optional plasticizers is 0.5:3 to 1:1.

8. The composition of claim 2, wherein said composition is an extudable explosive composition and said additional ingredients comprise 5 wt % to 35 wt % of one or more thermoplastic elastomers, up to 65 wt % of one or more oxidizers, 0 wt % to 90 wt % of one or more explosive fillers, and 0 wt % to 40 wt % of metals, and wherein both 2,2-dinitro-1,3-propanediol-diformate and other optional plasticizers are present in an amount up to 25 wt %.

9. The composition of claim 8, wherein said explosive fillers comprise one or more nitramines.

10. The composition of claim 2, wherein said composition is an explosive composition comprising as said additional ingredients one or more binders selected from the group consisting of nitrocellulose, poly(glycidyl nitrate), and poly (glycidyl azide).

11. The composition of claim 2, wherein said composition is a composite propellant composition.

12. The composition of claim 11, wherein said additional ingredients comprise 4 wt % to 30 wt % of one or more binders, 0.5 wt % to 3 wt % of one or more curatives, 0.25 wt % to 2 wt % of one or more cure catalysts, 40 wt % to 80 wt % of one or more oxidizers.

13. The composition of claim 12, wherein the 2,2-dinitro-1,3-propanediol-diformate and other optional plasticizers are present in a combined amount of up to 30 wt %.

14. The composition of claim 13, further comprising up to 5 wt % of one or more ballistic modifiers.

15. The composition of claim 2, wherein said composition is a double-base propellant composition.

16. The composition of claim 2, wherein said composition is a triple-base propellant composition.

* * * * *